US011723439B2

(12) United States Patent
Banks

(10) Patent No.: US 11,723,439 B2
(45) Date of Patent: Aug. 15, 2023

(54) SUPPORT BELTS AND BUCKLING FOR SUPPORT BELTS

(71) Applicant: SBD Apparel Ltd., London (GB)

(72) Inventor: Benjamin Banks, London (GB)

(73) Assignee: SBD Apparel Ltd., Rotherham (GB)

( * ) Notice: Subject to any disclaimer, the term of this patent is extended or adjusted under 35 U.S.C. 154(b) by 0 days.

(21) Appl. No.: 15/510,712

(22) PCT Filed: Aug. 18, 2015

(86) PCT No.: PCT/GB2015/052395
§ 371 (c)(1),
(2) Date: Mar. 13, 2017

(87) PCT Pub. No.: WO2016/038330
PCT Pub. Date: Mar. 17, 2016

(65) Prior Publication Data

US 2017/0245601 A1 Aug. 31, 2017

(30) Foreign Application Priority Data

Sep. 11, 2014 (GB) ..... 1416050

(51) Int. Cl.
*A44B 11/22* (2006.01)
*A41F 9/00* (2006.01)
(Continued)

(52) U.S. Cl.
CPC ..... *A44B 11/223* (2013.01); *A41F 9/002* (2013.01); *A41F 9/025* (2013.01); *A63B 71/12* (2013.01); *A63B 2244/09* (2013.01)

(58) Field of Classification Search
CPC ... A44B 11/223; A63B 71/12; A63B 2244/09; A41F 9/025; A41F 9/002; A41F 9/00;
(Continued)

(56) References Cited

U.S. PATENT DOCUMENTS 1,055,045 A 3/1913 Hunter
3,633,956 A 1/1972 Angell
(Continued)

FOREIGN PATENT DOCUMENTS

CH 700 607 B1 10/2014
GB 2 158 145 A 11/1985

OTHER PUBLICATIONS

Machine Translation of CH700607B1 by Lexis Nexis Total Patent on Mar. 13, 2017.

*Primary Examiner* — Khoa D Huynh
*Assistant Examiner* — Aiying Zhao
(74) *Attorney, Agent, or Firm* — Woodard, Emhardt, Henry, Reeves & Wagner, LLP

(57) ABSTRACT

A support belt (10) includes an elongate belt (12) having a dead end region (14) and a live end region (16) and buckling (18) to releasably connect the dead and live end regions (14,16) in a relaxed tightness condition of the support belt (10) and secure the dead and live end regions (14,16) in a tightened closed condition of the support belt (10) in which a free end (20) of the live end region (16) overlies a free end (22) of the dead end region (14). The buckling (18) comprises a first anchor portion (24) fixedly secured to the live end region (16), a second anchor portion (26) configured to releasably engage apertures (28) provided in the dead end region (14) and a locking mechanism (30) pivotally connected with the first and second anchor portions (24,26) and operable to draw the first anchor portion (24) towards the second anchor portion (26) to change the tightness condition of the support belt (10) from the relaxed tightness condition to the tightened closed condition.

8 Claims, 3 Drawing Sheets

(51) Int. Cl.
*A41F 9/02* (2006.01)
*A63B 71/12* (2006.01)

(58) Field of Classification Search
CPC ..... A41F 9/02; A41D 2200/10; Y10T 24/216; Y10T 24/45063; A43C 11/142; A44C 5/2042
USPC ..... 2/337, 338, 339, 311, 219; 24/170
See application file for complete search history.

(56) References Cited

U.S. PATENT DOCUMENTS

| | | | | |
|---|---|---|---|---|
| 3,637,257 | A * | 1/1972 | Uncapher | B65D 45/345 292/256.69 |
| 3,823,422 | A * | 7/1974 | Forgett, Jr. | A41F 9/002 2/321 |
| 4,369,529 | A * | 1/1983 | Yahata | A44B 11/223 2/322 |
| 4,470,177 | A | 9/1984 | Ganung et al. | |
| 4,541,152 | A * | 9/1985 | DiMarco | A44B 11/125 24/170 |
| 5,715,582 | A * | 2/1998 | Zorzi | A43C 11/1406 24/71 SK |
| 6,412,147 | B1 * | 7/2002 | Chen | A43C 11/1413 24/68 SK |
| 2005/0246868 | A1 * | 11/2005 | Garofalo | A43C 11/1446 24/170 |
| 2006/0053531 | A1 | 3/2006 | McBride et al. | |
| 2010/0093504 | A1 * | 4/2010 | Del Monte | A63B 21/065 482/105 |
| 2015/0283449 | A1 * | 10/2015 | White | A41F 9/002 2/322 |

* cited by examiner

SUPPORT BELTS AND BUCKLING FOR SUPPORT BELTS

FIELD OF THE INVENTION

The invention relates to support belts and buckling for support belts that may be used by persons lifting large weights, or loads.

BACKGROUND TO THE INVENTION

Body builders and weightlifters may use various lifting techniques to lift barbells. These lifts include the 'Bench Press', 'Squat' and 'Dead Lift' and may be employed by body builders working in the gym or by weightlifters in competition. In either case, the lifter's abdominal region may be put under considerable stress, particularly when lifting very heavy weights. To avoid damage to the lifter's body, it is known to wear a heavy duty weightlifter's belt to contain the torso between the ribcage and pelvic girdle. A similar need for support may arise in other sports or disciplines in which weight lifting is involved.

In order to provide the necessary containment, weightlifter's belts need to be stiff and relatively wide and when worn are secured tightly about the lifter's abdomen to pre-stress the abdominal region. The tightness of the support belt generates internal pressures in the abdomen that assist in preventing damage to the abdominal muscles and spine when they are subjected to the stresses imposed by a heavy lift. The stiffness and tightness of weightlifter's belts makes them uncomfortable to wear. This makes it desirable to be able to easily tighten the belt shortly before a lift takes place and then release it shortly afterwards. It may also be desirable to release a lifter's belt quickly in the event of a medical emergency.

SUMMARY OF THE INVENTION

The invention also includes a support belt as specified in claim 24.

The invention also includes buckling as specified in claim 34.

BRIEF DESCRIPTION OF THE DRAWINGS

In the following disclosure, reference will be made to the drawings, in which.

DETAILED DESCRIPTION

Figure 1:
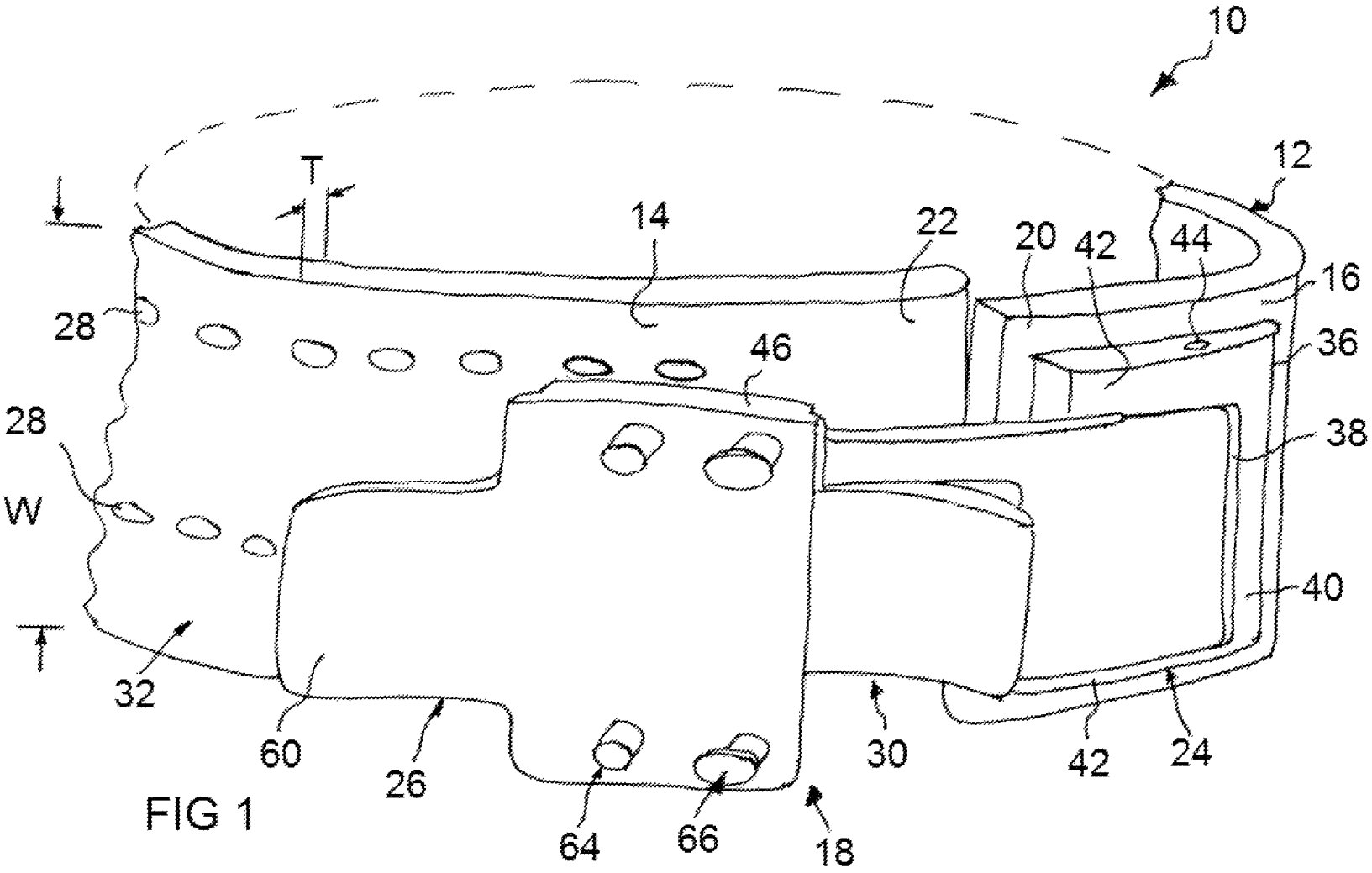
FIG. 1 is a perspective view of a support belt that may be used when weightlifting.

FIG. 1 shows an example of a support belt 10 that may be worn by persons lifting weights, such as body builders or weightlifters. The support belt 10 comprises an elongate belt 12 having a dead end region 14, a live end region 16 and buckling 18. The buckling 18 is operable to releasably connect the dead end and live end regions in a relaxed tightness condition of the support belt and secure them in at least one tightened closed condition of the support belt in which a free, or leading, end 20 of the live end region overlies a free, or trailing, end 22 of the dead end region. The buckling 18 comprises a first anchor portion 24 fixedly secured to the live end region 16, a second anchor portion 26 configured to releasably engage apertures 28 provided in the dead end region 14 and a locking mechanism 30 (FIG. 2) pivotally connected with the first and second anchor portions and configured to draw the second anchor portion 26 towards the first anchor portion 24 to change the tightness condition of the support belt from the relaxed tightness condition to a tightened closed condition.

The belt 12 has a length defined between the ends 20, 22. The belt length is selected to enable it to extend circumferentially around a designated waist size, or sizes, with some overlap at the dead and live end regions 14, 16 when the support belt is in its tightened closed position(s). The belt 12 has an inwardly facing side 31 (FIG. 4) and an outwardly facing side 32 disposed opposite the inwardly facing side 30. In use the inwardly facing side faces the wearer's body, while the outwardly facing side 32 faces away from the wearer's body. The belt 12 is a relatively heavy duty construction and may be made of leather or a suitable synthetic substitute. Examples of the belt 12 may have a thickness T in the range 10 to 13 mm and a width W in the range 75 to 100 mm. The heavy duty construction of the belt 12 makes it relatively stiff so that it will not readily yield to changes in contour from its natural curvature. The natural radius of curvature of the belt 12 may be limited by its thickness. This may make the support belt 10 relatively uncomfortable to wear, especially when in its tightened closed condition.

The dead end region 14 of the belt 12 is provided with a plurality of apertures 28. The apertures 28 are arranged to allow securing of the support belt 10 in a plurality of tightened closed conditions. While not essential, in the illustrated example the apertures 28 are arranged in two rows of aligned apertures disposed in parallel spaced apart relation to define pairs of apertures that are aligned in the widthways direction of the belt 12.

Figure 2:
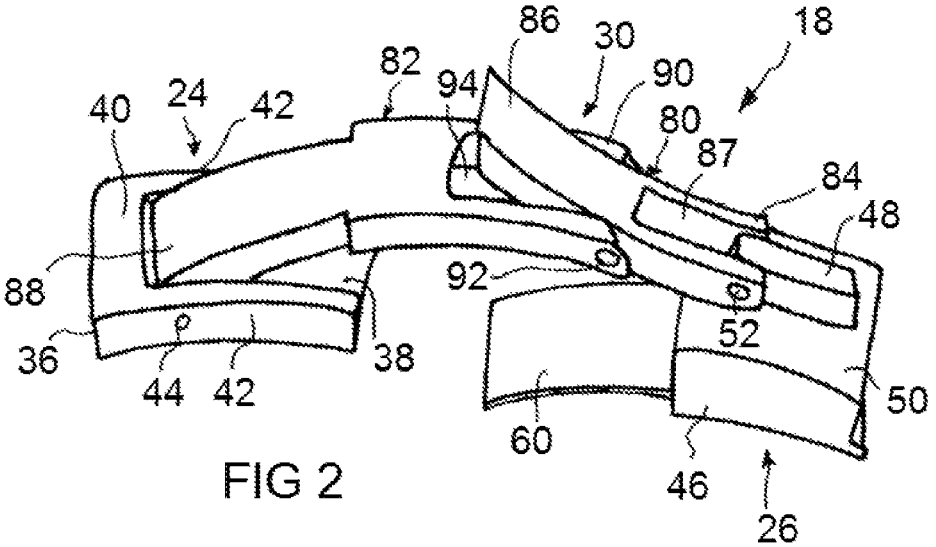
FIG. 2 is a perspective view of buckling of the support belt in an open condition.
Figure 3:
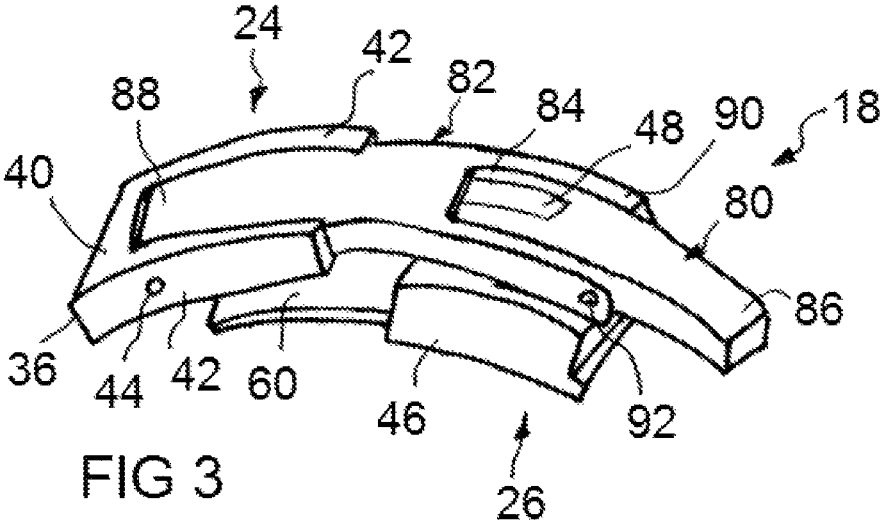
FIG. 3 is a perspective view of the buckling in a closed condition.

Referring to FIGS. 1 to 3, the first anchor portion 24 of the buckling 18 comprises a body 36. The body 36 has a generally rectangular profile and is curved, or arcuate, in the lengthways direction, or direction of pull, of the support belt 10. A generally rectangular recess 38 is defined in the body 36. The recess 38 is open at the outwardly facing side 40 of the body 36 and at its end disposed closest to the free end 20 of the live end region 16 of the belt 12. The recess 38 is bounded on two sides by oppositely disposed sidewalls 42 that are a part of the body 36. The recess 38 is configured to receive a portion of the locking mechanism 30. Respective through-holes are provided in the sidewalls 42 to receive a pivot pin 44 by which the locking mechanism 30 is pivotally connected to the first anchor portion 24.

The second anchor portion 26 of the buckling 18 comprises a generally rectangular body 46. A pivot mounting 48 is disposed on the outwardly facing side 50 of the body 46. Although not essential, in the illustrated example the pivot mounting 48 is a generally rectangular projection. The pivot mounting 48 is provided with a transverse through-hole (not shown) to receive a pivot pin 52 by which the over centre locking mechanism 30 is pivotally connected to the second anchor portion 26.

Figure 4:
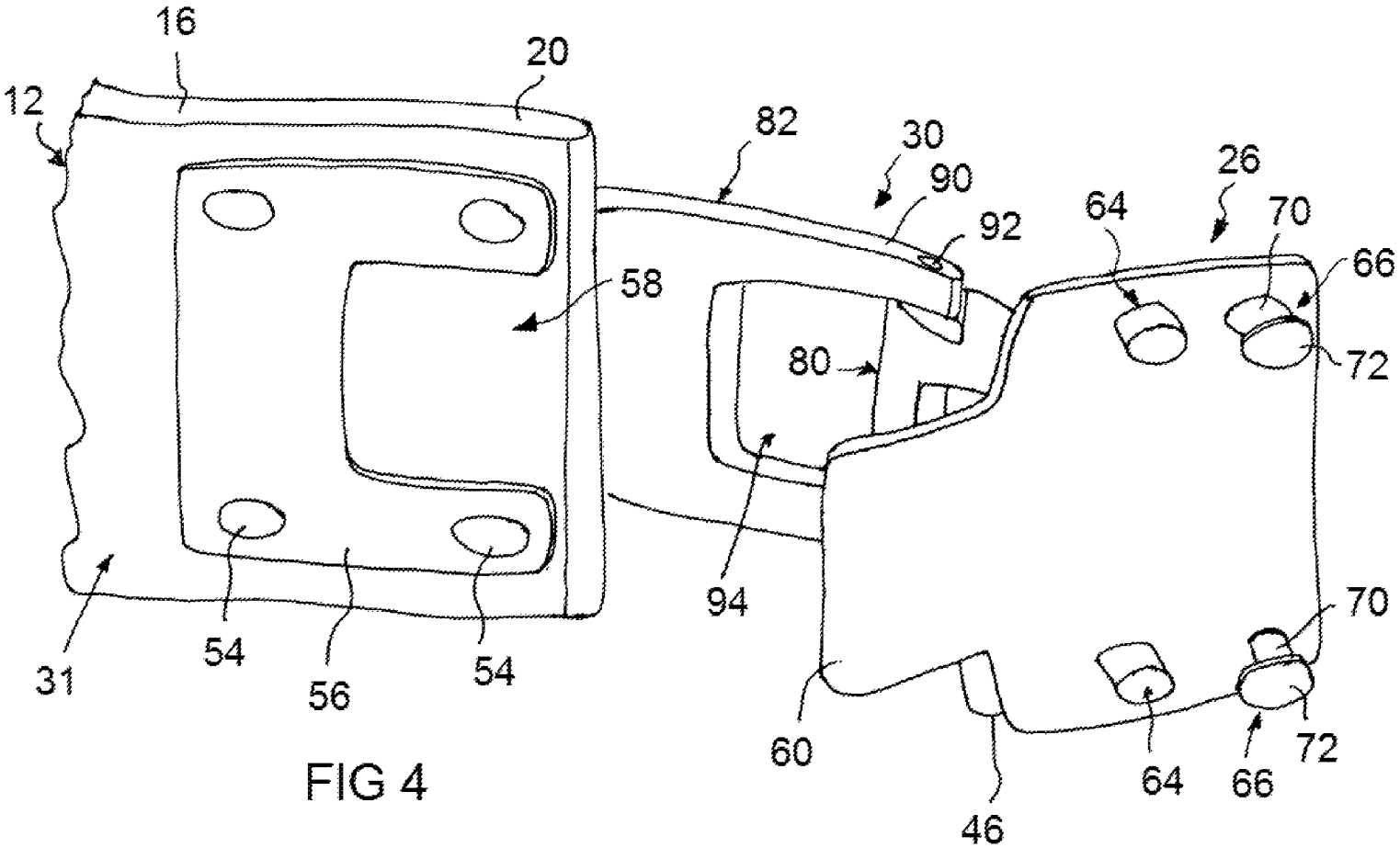
FIG. 4 is a perspective view of an inwardly facing side of a live end region of the support belt.

The first anchor portion 24 is fixedly secured to the live end region 16 of the belt 12 by securing means 54 (FIG. 4). The securing means 54 may be rivets, screws or the like. Although not essential, a keep plate 56 may be provided on the inwardly facing side 31 of the belt 12. The keep plate 56 may be disposed opposite the first anchor portion 24 and has respective apertures configured to receive the heads of the securing means 54. Optionally, the keep plate 56 may be generally U-shaped to define a guide recess 58 to receive a tongue 60 that extends from an end of the body 46 of the second anchor portion 26. The tongue 60 extends in the lengthways direction of the support belt 10 and is configured to slide into the guide recess 58 when the mechanism 30 is operated to secure the dead and live end regions 14, 16 in a tightened closed condition of the support belt 10. Tongue 60 is a guide member that assists the operator in properly aligning the dead and live end regions 14, 16.

As shown in FIGS. 1 and 4, the second anchor portion 26 is provided with two pin sets that each comprise a location pin 64 and a gripping pin 66. The location pins 64 are in line with and spaced from the respective gripping pins 66 in the lengthways direction of the belt 12. The pin sets are disposed in opposed spaced apart relation with the respective locating pins 64 aligned in the widthways direction of the belt 12 and the respective gripping pins 66 aligned in the widthways direction of the belt. The locating pins 64 are cylindrical bodies that have a diameter substantially corresponding to the diameter of the apertures 28 so that they are a snug fit in the apertures. The gripping pins 66 comprise a body portion 70, which is cylindrical and has a diameter less than the diameter of the apertures 28, and a head portion 72 projecting from the body portion and configured to engage against the inwardly facing side 31 of the dead end region 14. In other examples, instead of having a reduced diameter, the cross-section width of the body portion 70 in the lengthways direction of the belt 12 may be reduced, as compared with the diameter of the locating pins 64 and apertures 28, by providing a lengthways extending flat that faces towards the respective locating pin 64.

The locking mechanism 30 is pivotally connected to the first and second anchor portions 24, 26 and may be a toggle mechanism operable to draw, or pull, the first anchor portion towards the second anchor portion so as to reduce the spacing between the first and second anchor portions and draw the live end region 16 towards the dead end region 14. The locking mechanism 30 may be an over centre locking mechanism.

As best seen in FIGS. 2 and 3, in the illustrated example the locking mechanism 30 comprises a lever, or actuator, arm 80 and a connecting arm 82. The lever and connecting arms 80, 82 have generally rectangular cross-sections and each is curved, or arcuate, in the lengthways direction of the belt 12.

The lever arm 80 has a first end 84 and a second end 86. The first end 84 of the lever arm 80 is pivotally connected to the second anchor portion 26 via the pivot mounting 48 and pivot pin 52 so as to be movable between a first position (FIG. 2) corresponding to the relaxed tightness condition of the support belt 10 and a second position (FIG. 3) corresponding to a tightened closed condition. The first end 84 of the lever arm 80 is provided with a recess 87 that defines a yoke configured to receive the pivot mounting 48. The second end 86 of the lever arm 80 is gripped and manipulated to operate the locking mechanism 30. Accordingly, the second end 86 of the lever arm 80 may be contoured or provided with formations to facilitate gripping.

The connecting arm 82 has a first end 88 that is that is pivotally connected to the first anchor portion 24 via the pivot pin 44 housed in the sidewalls 42 of the recess 38. The second end 90 of the connecting arm 82 is pivotally connected to the lever arm 80 by a pivot pin 92 that passes through the lever arm at a position intermediate its first and second ends 84, 86. The second end 90 of the connecting arm 82 is provided with a recess 94 that defines a yoke in which the first end 84 of the lever arm 80 is received.

As best seen in FIG. 3, the lever arm 80 and connecting arm 82 are curved, or arcuate, in the lengthways direction of the belt 12. The curvature corresponds at least substantially to the curvature of the first and second anchor portions 24, 26. This enables the buckling 18 to conform generally to the curvature of the belt 12 and the lifter's body, at least better than it would if the parts were flat. Additionally, when the buckling 18 is in a tightened closed condition as shown in FIG. 3, the first end 88 of the connecting arm 82 is snugly received in the recess 38 in first anchor portion 24 and the second end 90 extends from the recess such that it forms a continuation of the body 36, while the first end 84 of the lever arm 80 is snugly received in the recess 94 provided in the second end 90 of the connecting arm and the second end 86 projects from the connecting arm such that it forms a continuation of the connecting arm. The result is that the outer surfaces of the buckling 18 combine to define a substantially continuous surface. This provides a pleasing aesthetic appearance that has the practical benefit of there being fewer edges and corners to dig into or catch the lifter's body and clothing.

In use, a lifter may prepare the support belt 10 for wear by separating the second anchor portion 26 from the dead end region 14 of the belt 12 and moving the dead and live end regions 12, 14 apart to allow the belt to be wrapped around their waist. Then with the buckling 18 in the open condition shown in FIG. 2, the second anchor portion 26 may be moved towards the dead end region 14 and the gripping and locating pins 64, 66 inserted into selected apertures 28. In some cases at least, it may be necessary for the lifter to raise the dead end region 14 a little away from their body to make it easier to insert the gripping pins 66. Once the head portions 72 of the gripping pins 66 have passed through the selected apertures 28 so that the respective body portions 70 are received in the apertures and the head formations 72 engage the inwardly facing side 31 of the belt 12, the dead end region 14 can be moved back towards the body and as the dead end region and second anchor portion 26 'flatten' against the body, the locating pins 64 will be forced into the respective selected apertures so that they are fully received in the apertures. At this stage with the buckling 18 in the open condition, the head portions 72 of the gripping pins 66 gripping against the inwardly facing side 31 of the belt 12 and the locating pins 64 fully received in their apertures 28, the dead and live end regions 14, 16 are in a releasably connected relaxed tightness condition. The lifter may select the apertures 28 in which the locating and gripping pins 64, 66 are received such that in this condition the belt 12 is slightly loose around the waist and comfortable to wear.

When the lifter wishes to lift a load, the second end 86 of the lever arm 80 is gripped and pulled to the right (as viewed in FIG. 2) to cause the lever arm to pivot in a clockwise direction (again as viewed in FIG. 2) about a pivot axis defined by the pivot pin 52. As the lever arm 80 moves to the right, the first anchor portion 24 and live end region 16 of the belt 12 are drawn towards the second anchor portion 26 and dead end region 14 by virtue of the connection of the second anchor portion to the lever arm by means of the connecting arm 82. As the first anchor portion 24 approaches the second anchor portion 26, the tongue 60 sliding into the recess 58 assists in guiding the live end region 16 toward the dead end region 14 in a straight line so that the longitudinal axis of the belt 12 in the dead and live end regions is at least substantially aligned and the belt ends do not twist.

Once the lever arm 80 has been moved to its fully closed position, as shown in FIG. 3, the dead and live end regions 14, 16 of the belt 12 are in a tightened closed condition in which the lifter's abdomen is pre-stressed to generate an internal pressure in the lifter's abdomen that may assist in preventing damage to the abdominal muscles and spine when they are subjected to the stresses imposed by a lift. The amount of pre-stressing provided by the support belt 10 will depend on the selection of the apertures 28 in which locating and gripping pins 64, 66 are received and the pull length defined by the distance between the respective axes of pivot pins 52, 92.

In a One-size' version of the support belt 10, there may be just four apertures 28 to receive respective pins 64, 66. In the illustrated example there is a series of apertures 28 extending along the length of the dead end region 14 to provide a series of size adjustment steps. This means that the support belt 10 can be quickly and easily be moved through a series of progressively tighter tightened closed conditions by releasing the buckling 18 disengaging the pins 64, 66 from the apertures 28 in the dead end region 14 of the belt 12 and moving to apertures that are disposed further from the free end 22 of the dead end region 14 of the belt 12 so as to reduce the diameter or circumference of the belt without detaching the first anchor portion 24 from the live end region 16 of the belt. A benefit of this is that in preparing for a lift, the lifter does not have to go straight from a loose relaxed tightness condition to a tightened closed position that would be used for lift. Instead, the lifter can move up through a series of steps in which the support belt 10 is used to induce progressively greater internal pressures in the lifter's abdomen so that the lifter can get used to relatively lower internal pressures before arriving at a relatively high level pressure required for performing a lift. A further benefit is that the support belt 10 is not One-size' making it susceptible to sharing. This also makes it easy to accommodate any reduction in waist size that may result from a lifter cutting weight for a competition.

In the illustrated example the apertures 28 are arranged in two rows extending in the lengthways direction of the belt 12 and there are respective pin sets 64, 66 to engage the two rows. In other examples, there may be just one row of apertures or three or more rows with a corresponding number of pin sets.

It will be understood that the provision of the connecting arm 82 makes it possible to configure the buckling 18 so that when the lever arm 80 is operated to change the tightness condition from the relaxed tightness condition to a tightened closed condition, the first anchor portion 24 and live end region 14 of the belt slide smoothly towards the second anchor portion 26 and dead end region 16 in a movement that is essentially circumferential with respect to the belt 12 or lifter's waist. Due to the relatively short range of the movement, it will often be essentially a straight line sliding movement. A benefit of this may be that the support belt 10 is less likely than known support belts to pinch the lifter's body or clothing during tightening. A further benefit is that the support belt may be tightened up to a maximum the lifter can withstand and be secured in that condition. With known belts, such as those that have a generally rectangular frame carrying one or more pivoting prongs that is fitted to one end of a belt so that the prongs can be inserted through holes in the other end of the belt, the belt passes through maximum tightness condition during the tightening process before finally arriving at a lower tightness when securing is complete.

The buckling 18 may be made of any material having sufficient strength to secure the belt 12 and cope with the loads imposed during lifting. Generally it is desirable that the buckling be kept as light as possible and so a suitable lightweight metal such as an aluminium alloy may be used. Alternatively, in other examples at least some parts of the bucking may be made of an engineering plastics material. When manufacturing from suitable metals, the parts of the buckling may be produced by a casting process, such as die casting.

In the illustrated example the lever arm pivots about a pivot axis carried by the anchor portion that releasably engages apertures of the dead end region of the belt to draw the anchor portion fixed to the live end region of the belt towards the dead end region of the belt. In other examples, the lever arm may pivot about a pivot axis provided on the anchor portion fixed to the dead end region of the belt to draw an anchor portion that releasably engages apertures of the live end region of the belt towards the dead end region.

In this specification parts of the support belt have been designated as a dead end region and a live end region. During tightening operations the dead end region tends to remain immobile against the wearer's body while the live end region is moved towards the dead end region by operation of the buckling. It is to be understood that this does not mean the dead end region remains fixed and incapable of movement. It simply means that at least the majority of the movement is made by the live end region moving towards or over the dead end region as the first anchor portion is drawn towards the second anchor portion.

The invention claimed is:

1. A weight lifting support belt comprising:

an elongate belt having a live end region and a dead end region, wherein said elongated belt defines an outwardly facing side and an inwardly facing side opposite the outwardly facing side, wherein the inwardly facing side faces the user when the weight lifting support belt is worn; and buckling to releasably connect and secure said live end region to said dead end region, wherein said buckling comprises a first anchor portion fixed to said live end region, a second anchor portion configured to releasably engage apertures provided in said dead end region to connect said live end region and said dead end region in a relaxed tightness condition of the support belt, a locking mechanism operable to cause a reduction in a spacing between said first anchor portion and said second anchor portion to change a tightness condition of the support belt from said relaxed tightness condition to a tightened closed condition in which a free end of said live end region overlies a free end of said dead end region, a first pivot pin pivotally connecting said first anchor portion to said locking mechanism and a second pivot pin pivotally connecting said second anchor portion to said locking mechanism, wherein said apertures provided in said dead end region of said belt are arranged to form at least one row apertures disposed in spaced apart relation along said dead end region to define a plurality of progressively tighter second anchor engagement positions, wherein said locking mechanism comprises a connecting arm and a separate lever arm pivotally connected to said connecting arm by a third pivot pin and operable to generate a pulling force to cause said reduction in said spacing between said first and second anchor portions, whereby a wearer can progressively tighten the belt through progressively tighter tightened closed conditions without detaching the first anchor portion from the live end region of the belt by operating said locking mechanism to change the tightness condition of the support belt from said tightened closed condition to said relaxed tightness condition, disengaging said second anchor portion from said at least one row of apertures and re-engaging said second anchor portion with said at least one row of apertures in a tighter one of said progressively tighter second anchor engagement positions and operating said locking mechanism to change the tightness condition of the support belt from said relaxed tightness condition to said tightened closed condition, and wherein said first anchor portion is disposed against the outwardly facing side of said elongate belt and further comprising a fixing plate disposed opposite said first anchor portion against the inwardly facing side of said elongate belt, said fixing plate defining a recess and said second anchor portion comprising a tongue configured to slide into said recess during tightening of said buckling.

2. The weight lifting support belt as claimed in claim 1, wherein said locking mechanism is configured such that said pulling force pulls said second anchor portion towards said first anchor portion.

3. The weight lifting support belt as claimed in claim 1, wherein said locking mechanism is configured such that said pulling force causes a relative movement of said first and second anchor portions that is in a circumferential direction of said elongate belt.

4. The weight lifting support belt as claimed in claim 1, wherein said second anchor portion comprises as least one pin set by which the second anchor portion releasably engages said apertures and a said pin set comprises a locating pin having a first diameter and a gripping pin that is spaced from said locating pin in a lengthways direction of said belt and has a body portion that has a width that is less than said first diameter and a head portion projecting from said body portion and configured to engage against an inwardly facing side of said dead end region when said body portion is received in a said aperture.

5. The weight lifting support belt as claimed in claim 1, wherein said lever arm has a first end and a second end and said pivotal connection with said connecting arm is at a position intermediate said first and second ends of said lever arm.

6. The weight lifting support belt as claimed in 5, wherein said connecting arm has a first end and a second end, said second end of said connecting arm defines a recess configured to receive said first end of said lever arm when said buckling is in said tightened closed condition such that said lever arm forms a continuation of said connecting arm with said second end of said lever arm projecting from said second end of said connecting arm.

7. The weight lifting support belt as claimed in claim 6, wherein said first end of said connecting arm is received in a recess defined in one of said first and second anchor portions and said recess and connecting arm are configured such that when said support belt is in said tightened closed condition said connecting arm forms a continuation of said one of said first and second anchor portions with said second end of said connecting arm projecting from said one of said first and second anchor portions and overlying the other of said first and second anchor portions.

8. A weight lifting support belt comprising:

an elongate belt having a live end region and a dead end region, a plurality of apertures provided in said dead end region, wherein said elongated belt defines an outwardly facing side and an inwardly facing side opposite the outwardly facing side, wherein the inwardly facing side faces the user when the weight lifting support belt is worn; and buckling to releasably connect said live and dead end regions in a relaxed tightness condition of the support belt and secure said live and dead end regions in a tightened closed condition, wherein said buckling comprises a first anchor portion secured to said live end region by rivets or screws, a second anchor portion configured to releasably engage said apertures provided in said dead end region and a locking mechanism pivotally connected to said first and second anchor portions, wherein said locking mechanism comprises a connecting arm and a lever arm pivotally connected to said connecting arm, said connecting arm and lever arm are each pivotally connected to said first and second anchor portions and said locking mechanism is operable to generate a pulling force to cause a reduction in a spacing between said first and second anchor portions to change the tightness condition of the support belt from said relaxed tightness condition to said tightened closed condition, wherein said live end region overlies a free end of said dead end region when said support belt is in said tightened closed condition, wherein said apertures provided in said dead end region are arranged to form at least one row of apertures disposed in spaced apart relation along said dead end region to define a plurality of progressively tighter second anchor portion engagement positions, wherein said second anchor portion comprises at least one pin set by which the second anchor portion releasably engages said apertures and a said pin set comprises a locating pin having a first diameter and a gripping pin that is spaced from said locating pin in a lengthways direction of said belt and has a body portion that has a width that is less than said first diameter and a head portion projecting from said body portion and configured to engage against an inwardly facing side of said dead end region when said body portion is received in a said aperture, wherein said first anchor portion is disposed against the outwardly facing side of said elongate belt and further comprising a fixing plate disposed opposite said first anchor portion against the inwardly facing side of said elongate belt, said fixing plate defining a recess and said second anchor portion comprising a tongue configured to slide into said recess during tightening of said buckling, and wherein a wearer can progressively tighten the belt without detaching the first anchor portion from the live end region of the belt by operating said locking mechanism to change the tightness condition of the support belt from said tightened closed condition to said relaxed tightness condition, disengaging said at least one pin set from said at least one row of apertures, re-engaging said at least one pin set with said at least one row of apertures in a tighter one of said progressively tighter second anchor portion engagement positions and operating said locking mechanism to change the tightness condition of the support belt from said relaxed tightness condition to said tightened closed condition.

* * * * *